US009960531B2

(12) United States Patent
Poncini et al.

(10) Patent No.: US 9,960,531 B2
(45) Date of Patent: May 1, 2018

(54) CABLE CONNECTOR

(71) Applicant: Johnson Electric S.A., Murten (CH)

(72) Inventors: Renato Poncini, Asti (IT); Marco Bussa, Viarigi (IT)

(73) Assignee: Johnson Electric S.A., Murten (CH)

( * ) Notice: Subject to any disclaimer, the term of this patent is extended or adjusted under 35 U.S.C. 154(b) by 0 days. days.

(21) Appl. No.: 15/395,283

(22) Filed: Dec. 30, 2016

(65) Prior Publication Data

US 2017/0194738 A1 Jul. 6, 2017

(30) Foreign Application Priority Data

Dec. 30, 2015 (IT) ..... 102015000089212

(51) Int. Cl.

| | |
|---|---|
| ***H01R 13/58*** | (2006.01) |
| ***H01R 4/02*** | (2006.01) |
| ***H01R 13/502*** | (2006.01) |
| ***H01R 13/66*** | (2006.01) |
| ***H01R 4/70*** | (2006.01) |
| *H01R 13/52* | (2006.01) |
| *H01R 13/719* | (2011.01) |
| *H01R 43/00* | (2006.01) |

(52) U.S. Cl.

CPC ..... *H01R 13/5845* (2013.01); *H01R 4/023* (2013.01); *H01R 4/029* (2013.01); *H01R 4/70* (2013.01); *H01R 13/502* (2013.01); *H01R 13/5216* (2013.01); *H01R 13/6625* (2013.01); *H01R 13/6633* (2013.01); *H01R 13/5213* (2013.01); *H01R 13/719* (2013.01); *H01R 43/005* (2013.01)

(58) Field of Classification Search

CPC ..... H01R 13/5845
USPC ..... 439/606; 361/18, 572
See application file for complete search history.

(56) References Cited

U.S. PATENT DOCUMENTS

| | | | | |
|---|---|---|---|---|
| 4,335,932 | A * | 6/1982 | Herrmann, Jr. | B29C 33/0016 174/541 |
| 5,145,402 | A * | 9/1992 | Plyler | H01R 13/5219 439/274 |
| 5,580,260 | A | 12/1996 | Flieger et al. | |
| 6,815,610 | B2 * | 11/2004 | Kuboshima | H01R 9/032 174/360 |
| 6,957,981 | B2 * | 10/2005 | Karino | H01R 13/5845 439/606 |

(Continued)

FOREIGN PATENT DOCUMENTS

| | | |
|---|---|---|
| JP | H1126035 A | 1/1999 |
| JP | H1197116 A | 4/1999 |

(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

A cable connector is provided which includes an insulating body including a frame which defines a region therein; a plurality of electrical terminals fixed to the insulating body and extended into the region; and a plurality of cables electrically connected to the electrical terminals respectively in the region. The region is filled with an insulator to embed the electrical terminals and the cables. The cable connector has a relatively high reliability.

15 Claims, 5 Drawing Sheets

(56) References Cited

U.S. PATENT DOCUMENTS 6,960,102 B2 * 11/2005 Styles ..... H01R 4/72 439/276
7,002,807 B2 * 2/2006 Takabatake ..... H01R 13/5216 174/528
7,165,995 B2 * 1/2007 Fukushima ..... H01R 43/24 174/359
7,387,551 B2 * 6/2008 Kurahashi ..... H01R 43/24 439/670
7,390,217 B2 * 6/2008 Scott ..... G01V 1/201 439/604
7,597,580 B1 * 10/2009 Advey ..... H01R 13/502 439/272
8,192,222 B2 * 6/2012 Kameyama ..... H01R 9/03 439/404
8,272,895 B2 * 9/2012 Park ..... H01R 13/5202 439/587
8,277,250 B2 * 10/2012 Suzuki ..... B29C 70/845 439/604
8,449,328 B2 * 5/2013 Ooki ..... C08L 53/025 439/271
8,485,844 B2 * 7/2013 Omae ..... H01R 13/5202 439/559
8,905,784 B2 * 12/2014 Perotto ..... B29C 45/14639 439/587
9,083,107 B2 * 7/2015 Suzuki ..... H01R 13/5219
2004/0057187 A1 * 3/2004 Kuboshima ..... H01R 9/032 361/118
2007/0077828 A1 * 4/2007 Kurahashi ..... H01R 43/24 439/884
2012/0289087 A1 * 11/2012 Fujisaki ..... H01R 43/20 439/606
2013/0154362 A1 * 6/2013 Takaka ..... B60L 11/1818 307/9.1
2013/0203284 A1 * 8/2013 Perotto ..... B29C 45/14639 439/530

FOREIGN PATENT DOCUMENTS

JP 2001160461 A 6/2001
JP 3412201 B2 * 6/2003
JP 3412201 B2 6/2006
JP 2012028407 A 2/2012

* cited by examiner

CABLE CONNECTOR

CROSS REFERENCE TO RELATED APPLICATIONS

This non-provisional patent application claims priority under 35 U.S.C. § 119(a) from Patent Application No. 102015000089212 filed in Italy on Dec. 30, 2015, the entire contents of which are hereby incorporated by reference.

FIELD OF THE INVENTION

This invention relates to a cable connector, in particular an integrated cable connector.

BACKGROUND OF THE INVENTION

The cable connector is widely used in many technical fields, such as motor vehicles. Usually, the cable connector includes an insulating body with a plurality of electrical terminals, and a plurality of cables respectively welded to corresponding electrical terminals. Such cable connector is liable to be subject to short circuits.

SUMMARY OF THE INVENTION

Hence there is a desire for cable connector which makes it possible to remedy this problem.

Accordingly, the present invention provides a cable connector which includes an insulating body comprising a frame which defines a region therein; a plurality of electrical terminals fixed to the insulating body and extending into the region; and a plurality of cables electrically connected to the electrical terminals respectively in the region. The region is filled with an insulator to embed the electrical terminals and the cables.

In the above cable connector, the insulator can achieve an effective and stable electrical insulation between the terminals and the cables embedded therein, and effective protect against the infiltration of water, therefore to reduce the occurrence of short circuits.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present disclosure, any other embodiment obtained by a person skilled in the art without paying any creative effort shall fall within the protection scope of the present invention.

It is noted that, when a component is described to be "fixed" to another component, it can be directly fixed to the another component or there may be an intermediate component. When a component is described to be "connected" to another component, it can be directly connected to the another component or there may be an intermediate component. When a component is described to be "disposed" on another component, it can be directly disposed on the another component or there may be an intermediate component. The directional phraseologies such as "perpendicular", "horizontal", "left", "right" or similar expressions are for the purposes of illustration only.

Unless otherwise specified, all technical and scientific terms have the ordinary meaning as understood by people skilled in the art. The terms used in this disclosure are illustrative rather than limiting. The term "and/or" as used in this disclosure means that each and every combination of one or more associated items listed are included.

Figure 1:
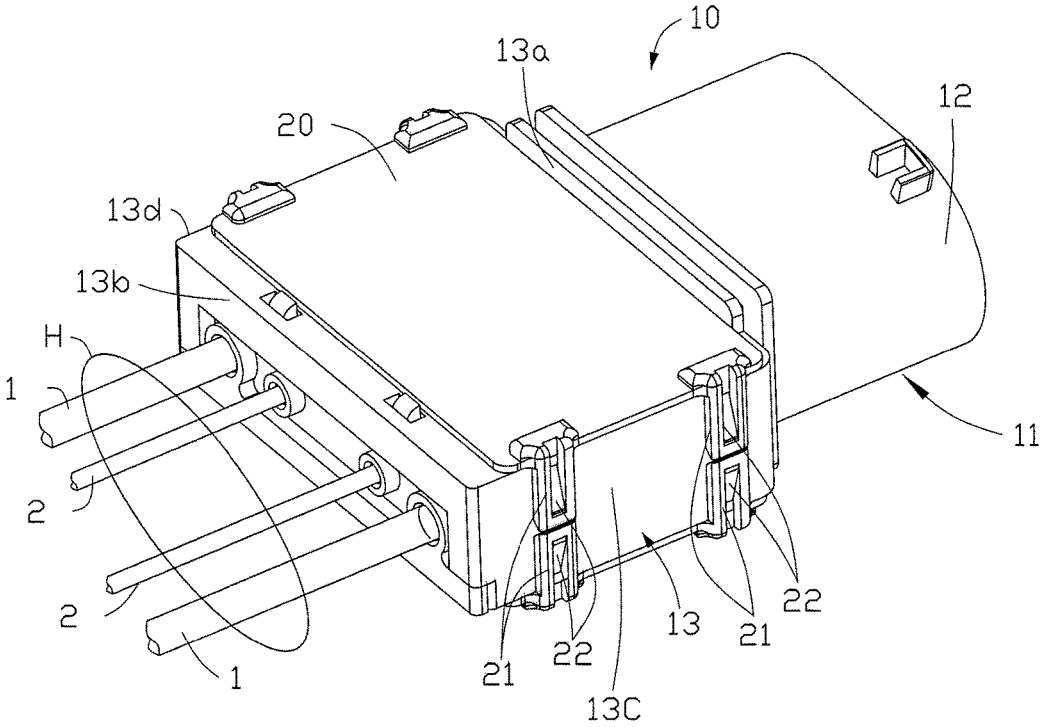
FIG. 1 is an assembly view of an cable connector in the preferred embodiment.
Figure 2:
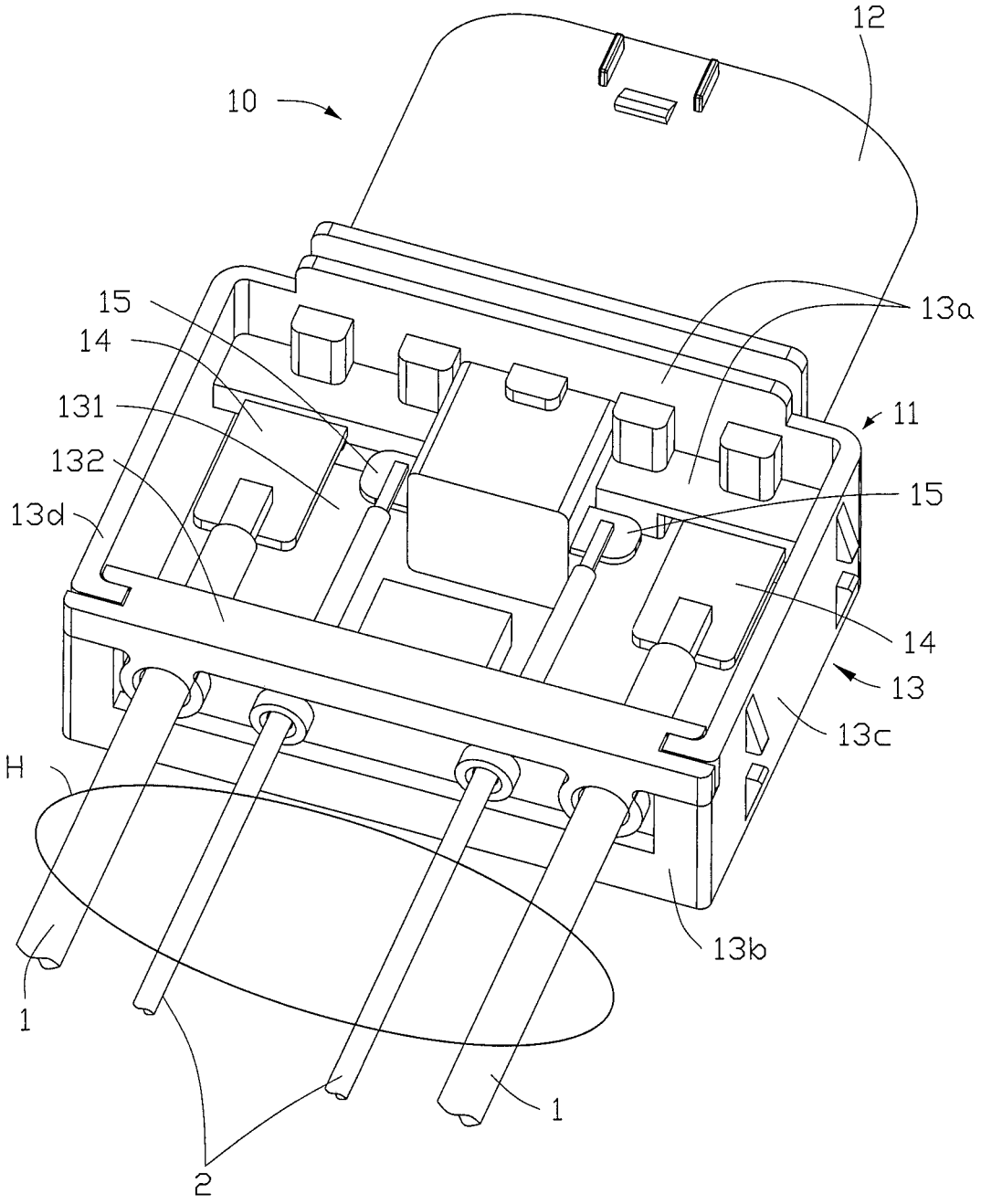
FIG. 2 illustrates the connection between the cables and the electrical terminals from a top of the cable connector of FIG. 1.
Figure 3:
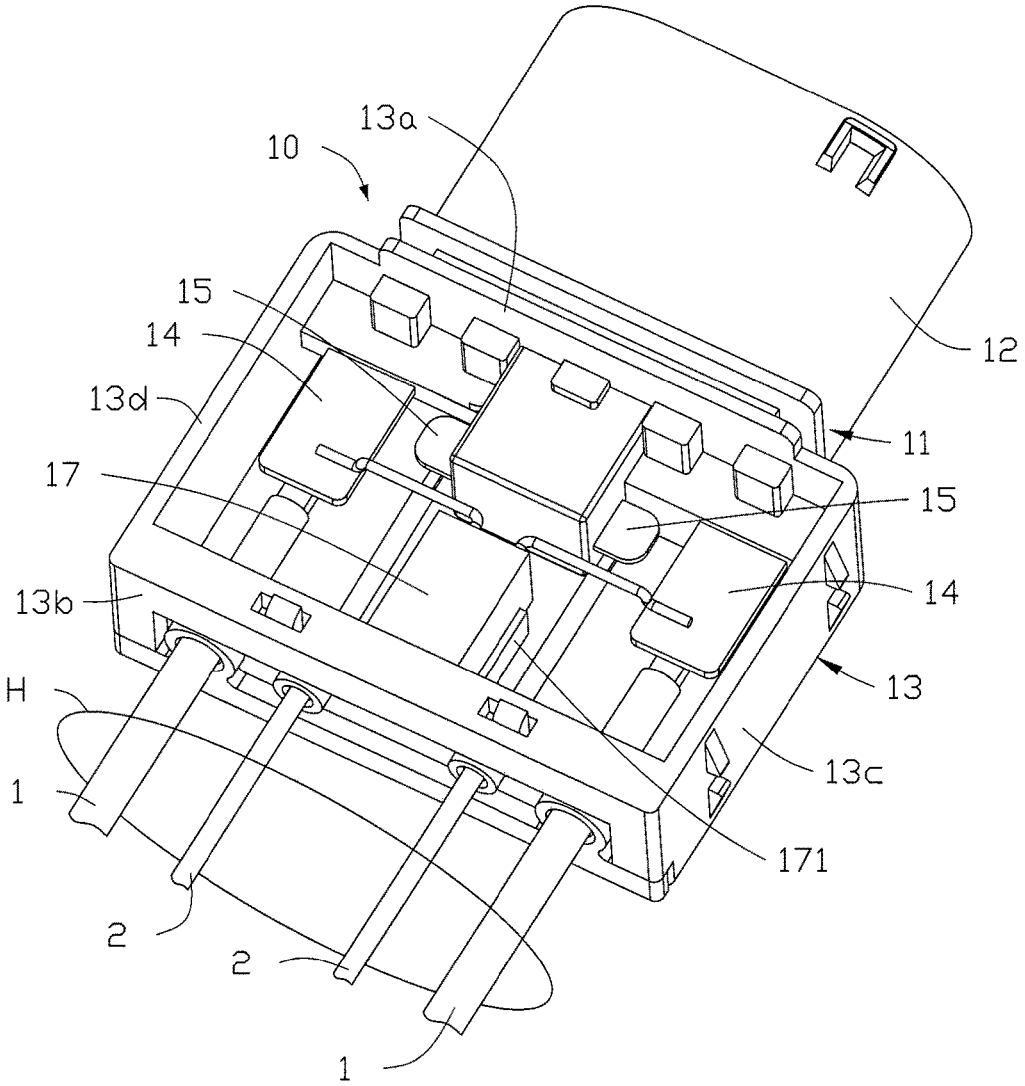
FIG. 3 illustrates the connection between the cables and the electrical terminals from a bottom of the cable connector of FIG. 1.
Figure 4:
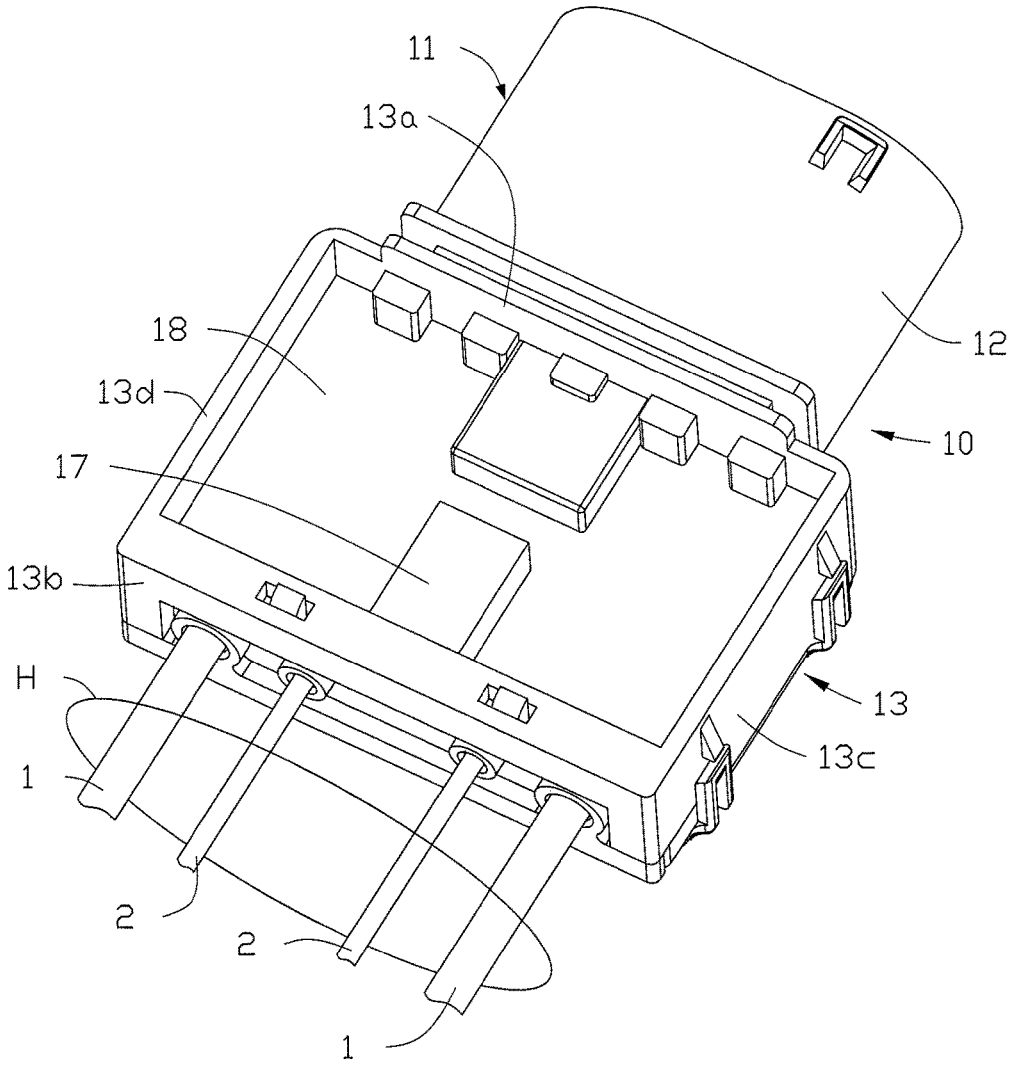
FIG. 4 illustrates the cable connector of FIG. 1 with a top cover thereof removed to show an interior of the cable connector.
Figure 5:
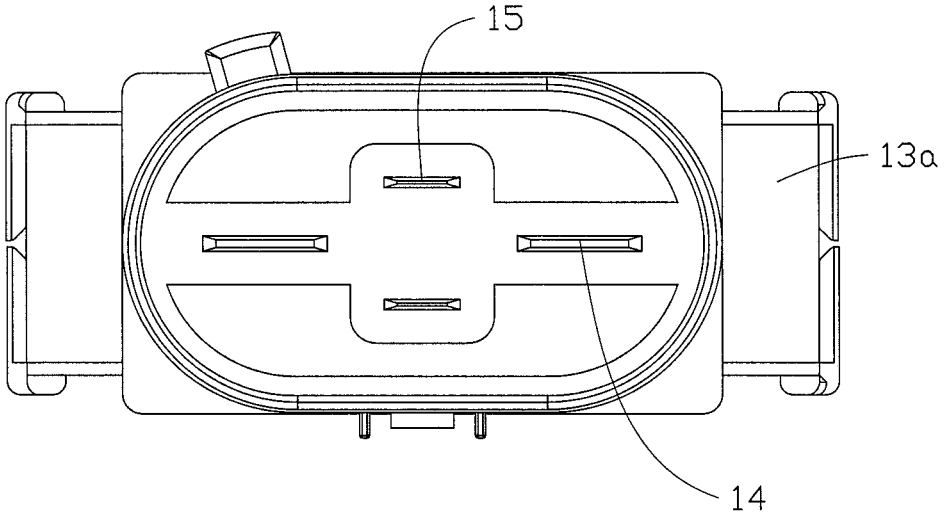
FIG. 5 is a side view of the cable connector of FIG. 1.

Referring to FIGS. 1-4, a cable connector 10 includes an electrically insulating body 11, a plurality of electrical terminals 14, 15, and a plurality of cables 1, 2. The electrical terminals 14, 15 are respectively fixed to the insulating body 11. The insulating body 11 includes a housing 12 for coupling with a corresponding connector, and a frame 13. Each electrical terminal is located in the housing 12 and extends into a region 131 surrounded by the frame 13. The electrical terminals 14, 15 and the corresponding cables 1, 2 are connected in the region 131, respectively. The region 131 is filled with an insulator 18 which is formed by injection molding and solidified into the region 131 to embed the electrical terminals 14, 15 and the cables 1, 2. The material of the insulator 18 can be synthetic resin.

Preferably, the insulating body 11 is made of moulded plastic material. The electrical terminals 14, 15 are provided in the insulating body 11 in a moulding operation. The electrical terminals 14, 15 and the corresponding cables 1, 2 are connected by welding.

The cable connector 10 further includes at least one electromagnetic shielding element 17 disposed in the region 131 surrounded by the frame 13. The electromagnetic shielding element 17 can be a capacitor, inductor, ferrite or other components which is able to reduce electromagnetic interference. The terminals of the electromagnetic shielding element 17 are embedded in the insulator 18, and respectively connected to the corresponding electrical terminals 14. Preferably, a holder 171 extends from the frame 13 into the region 131, to carry the at least one electromagnetic shielding element 17. The terminals of the electromagnetic shielding element 17 and the corresponding electrical terminals 14 are connected by welding.

Advantageously, the insulator 18 can achieve an effective and stable electrical insulation between the terminals and the cables embedded therein, and effective protect against the infiltration of water, thus reducing the occurrence of short circuits.

Referring again to FIG. 2, the ends of the cables 1, 2 are welded to the corresponding electrical terminals 14, 15 from the top side of the frame 13. Referring again to FIG. 3, the terminals of the electromagnetic shielding element 17 are welded to the corresponding electrical terminals 14 from the bottom side of the frame 13.

In the embodiment, the frame 13 is a hollow frame, substantially rectangular, and preferably made integral with the housing 12. A portion of each electrical terminal is embedded in the housing 12, insulated from each other by the housing 12. The cable connector 10 further includes two opposite covers 20 respectively fixed to the top side and the bottom side of the frame 13. The covers 20 can be made of plastic material, to cover and protect the insulator 18.

The frame 13 includes a first sidewall 13*a* and a second sidewall 13*b* which are perpendicular to the extension direction of the cables 1, 2, a third sidewall 13*c* and a fourth sidewall 13*d* along the extension direction of the cables 1, 2. The covers have engagement formations 21 coupled with corresponding retaining formations 22 arranged on the outer surfaces of the third sidewall 13*c* and the fourth sidewall 13*d*. The electrical terminals 14, 15 extend through first sidewall 13*a*.

Preferably, the middle electrical terminals 15 are overlapped in height direction of frame 13 from top cover 20 to bottom cover 20, so the size of the housing can be reduced.

In the embodiment, the insulating body 11 further includes a mounting plate 132 with a plurality of passages or holes through which the cables 1, 2 can pass. The second sidewall 13*b* has a notch fitted for the mounting plate 132. In alternative embodiments, the mounting plate 132 also can be made integrally with the second sidewall 13*b*.

Referring again to FIGS. 1-4, the symbol H indicates a plurality of electrical cables 1 and 2. In the exemplary illustrated embodiment, the number of the cables H is four, two power cables and two signal cables, but the number of the cables H is not limited to four cables in other embodiments.

It should be understood that the frame 13 shall not be limited to hollow frame, rectangular or made integral with the housing 12. For example, the frame can be other shape. The frame 13 can has a bottom and the cable connector 10 only includes one cover fixed to the top side of the frame 13. The housing 12 can be made separately and mounted to the frame 13.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A cable connector comprising:

an insulating body comprising a frame which defines a region therein;

a plurality of electrical terminals fixed to the insulating body and extending into the region; and a plurality of cables electrically connected to the electrical terminals respectively in the region;

wherein the region is filled with an insulator to embed the electrical terminals and the cables, wherein the cable connector further comprises a mounting plate with a plurality of holes through which the cables pass the mounting plate, and the mounting plate with the cables is fixed to the frame, and wherein the cable connector further comprises two opposite covers, the frame is a hollow frame, and the covers are respectively coupled to two sides of the frame to protect the insulator.

2. The cable connector of claim 1, further comprising at least one electromagnetic shielding element disposed in the region, wherein two terminals of the electromagnetic shielding element are embedded in the insulator, and respectively connected to the corresponding electrical terminals.

3. The cable connector of claim 2, wherein the at least one electromagnetic shielding element is a capacitor or an inductor.

4. The cable connector of claim 2, wherein a holder extends from the frame into the region, the at least one electromagnetic shielding element is carried by the holder.

5. The cable connector of claim 2, wherein the ends of the cables are welded to corresponding electrical terminals from a side of the frame, and the terminals of the electromagnetic shielding element are welded to corresponding electrical terminals from another side of the frame.

6. The cable connector of claim 1, wherein the frame comprises a first sidewall and a second sidewall which are perpendicular to the extension direction of the cables, a third sidewall and a fourth sidewall along the extension direction of the cables, and wherein the covers have engagement formations coupled with corresponding retaining formations arranged on the outer surfaces of the third sidewall and the fourth sidewall.

7. The cable connector of claim 1, further comprising a cover, wherein the frame has a bottom, the cover is fixed to a top side of the frame to protect the insulator.

8. The cable connector of claim 1, wherein the insulator is formed by injecting and curing resin.

9. The cable connector of claim 8, wherein the insulator is made of synthetic resin.

10. The cable connector of claim 1, wherein the frame comprises four sidewalls, and one of the sidewalls has a notch fitted for the mounting plate.

11. The cable connector of claim 1, wherein the insulating body further comprises a housing for coupling with a corresponding connector, a portion of each electrical terminal is embedded in the housing.

12. The cable connector of claim 11, wherein the housing is made integrally with the frame.

13. The cable connector of claim 11, wherein the housing is mounted on the frame.

14. The cable connector of claim 1, wherein middle electrical terminals of the electrical terminals located in the housing are overlapped in a height direction of the frame from top to bottom.

15. The cable connector of claim 14, wherein the housing is made integrally with the frame, the cable connector comprises at least four electrical terminals, and at least two middle electrical terminals located in the housing are overlapped in the height direction of the frame.

* * * * *